US005662215A

United States Patent [19]

Focke et al.

[11] Patent Number: 5,662,215

[45] Date of Patent: Sep. 2, 1997

[54] PACK MADE FROM THIN PACKAGING MATERIAL AND PROCESS FOR THE PRODUCTION OF SAID PACK

[75] Inventors: Heinz Focke; Jürgen Focke, both of Verden, Germany

[73] Assignee: Focke & Co. (GmbH & Co.), Verden, Germany

[21] Appl. No.: 643,105

[22] Filed: May 2, 1996

Related U.S. Application Data

[63] Continuation of Ser. No. 220,880, Mar. 31, 1994, abandoned.

[30] Foreign Application Priority Data

Apr. 1, 1993 [DE] Germany ..... 43 10 646.3

[51] Int. Cl.[6] ..... B65D 85/10

[52] U.S. Cl. ..... 206/273; 229/87.06; 229/87.13

[58] Field of Search ..... 206/271, 273, 206/242, 260; 229/87.13, 87.06

[56] References Cited

U.S. PATENT DOCUMENTS

| | | | |
|---|---|---|---|
| 2,294,220 | 8/1942 | Albertson . | |
| 2,895,601 | 7/1959 | Krukonis | 206/273 X |
| 3,063,553 | 11/1962 | Nicholson . | |
| 3,306,517 | 2/1967 | Diesinger, Jr. . | |
| 3,596,758 | 8/1971 | Phillips, Jr. et al. | 206/273 X |
| 5,147,037 | 9/1992 | Evers et al. | 206/273 X |
| 5,351,820 | 10/1994 | Focke et al. | 206/273 |

FOREIGN PATENT DOCUMENTS

| | | |
|---|---|---|
| 519257 | 12/1992 | European Pat. Off. . |
| 317785 | 12/1919 | Germany . |
| 1988564 | 6/1968 | Germany . |
| 2709236 | 2/1985 | Germany . |
| 9114031 | 3/1992 | Germany . |
| 4036889 | 5/1992 | Germany . |
| 4120059 | 12/1992 | Germany . |
| 4134567 | 1/1993 | Germany . |
| 4213489 | 5/1993 | Germany . |
| 2211174 | 6/1989 | United Kingdom . |

*Primary Examiner*—Jacob K. Ackun

*Attorney, Agent, or Firm*—Sughrue, Mion, Zinn, Macpeak & Seas

[57] ABSTRACT

A pack made from thin or low-strength packaging material, especially a bundle pack for cigarettes. To increase the load-bearing capacity of a pack made from thin packaging material, for example paper, a blank for an outer wrapping (14) is provided with local reinforcements, namely, for example, reinforcing strips 15, 16, 17, 18 which are arranged at distances from one another and parallel to one another preferably on the inside of the blank, and which are connected to the latter. As regards outer wrappings (14) having windows or recesses (19) for affixing revenue stamps, etc. to the wrapped cigarette packs (10), the reinforcing strips (15 to 18) extend in such a way that transverse webs (22) formed between the recesses (19) each have a reinforcement.

14 Claims, 6 Drawing Sheets

PACK MADE FROM THIN PACKAGING MATERIAL AND PROCESS FOR THE PRODUCTION OF SAID PACK

This is a continuation of application Ser. No. 08/220,880 filed Mar. 31, 1994, and now abandoned.

BACKGROUND OF THE INVENTION

The invention relates to a pack (outer wrapping) made from thin or low-strength packaging material, especially paper, for forming a bundle pack containing a group of individual cigarette packs, the outer wrapping having recesses for affixing markings in the region of end faces or bottom faces of the cigarette packs. The invention relates, furthermore, to a process for the production of blanks for the outer wrapping of packs of this type.

For reasons of cost, in particular for the saving of material, it is desirable to use thin material or packaging material having a low tearing strength for outer wrappings of packs. This includes primarily paper. In larger packs, namely so-called bundle packs, in which a relatively large number of individual packs is combined by means of a common outer wrapping, the tearing strength of the material plays a special part. Bundle packs for cigarette packs are therefore often provided with an outer wrapping made from cardboard. This applies especially when the outer wrapping has weakening regions necessitated by technical or design factors. There may be mentioned as an example of this recesses in the outer wrapping which are made in the region of bottom faces of the cigarette packs, in order to provide these with a marking, especially with a revenue stamp. Increased tensile stresses naturally occur in the material of the outer wrapping in the region of the recesses limited by longitudinal and transverse webs, with the risk that the outer wrapping will be destroyed.

SUMMARY OF THE INVENTION

The object on which the invention is based is to propose packs, especially bundle packs for cigarette packs, in which the outer wrapping consists of a cost-effective material, especially of paper, but sufficient strength against (tensile) stresses in the material is nevertheless provided.

To achieve this object, the pack according to the invention is characterized by local reinforcing strips increasing the tearing strength of the outer wrapping and located at least in the region of the recesses.

The idea of the invention is accordingly, at the factory, to provide a packaging material having a low tearing strength with local reinforcements, specifically in the region of increased tearing loads. As a result, on the one hand cost-effective packaging material can be used, but on the other hand the durability of the pack can be guaranteed.

According to a further proposal of the invention, the reinforcements are designed as tear-resistant, narrow reinforcing strips which are arranged at a distance from one another and which extend over the entire length of the blank. The reinforcing strips preferably consist of tear-resistant plastic and are affixed to the inside of the outer wrapping by adhesive bonding or heat-sealing.

According to the invention, instead of individual reinforcing strips, a large-area reinforcing label can be affixed locally to the outer wrapping by adhesive bonding or sealing. In a pack having recesses ("windows"), this reinforcing label is located in the region of the recesses, these being surrounded preferably all-round by the reinforcing label provided with corresponding recesses.

According to the invention, the reinforcements are affixed to the continuous material web or the blank for the outer wrapping after the blank has been severed from the material web. The affixation of the reinforcements is integrated into the continuous conveying or production process for the blanks.

Further details of the invention are explained below by means of exemplary embodiments of the packs or of the blanks for the outer wrapping of these. In the drawing:

DESCRIPTION OF PREFERRED EMBODIMENTS

Figure 1:
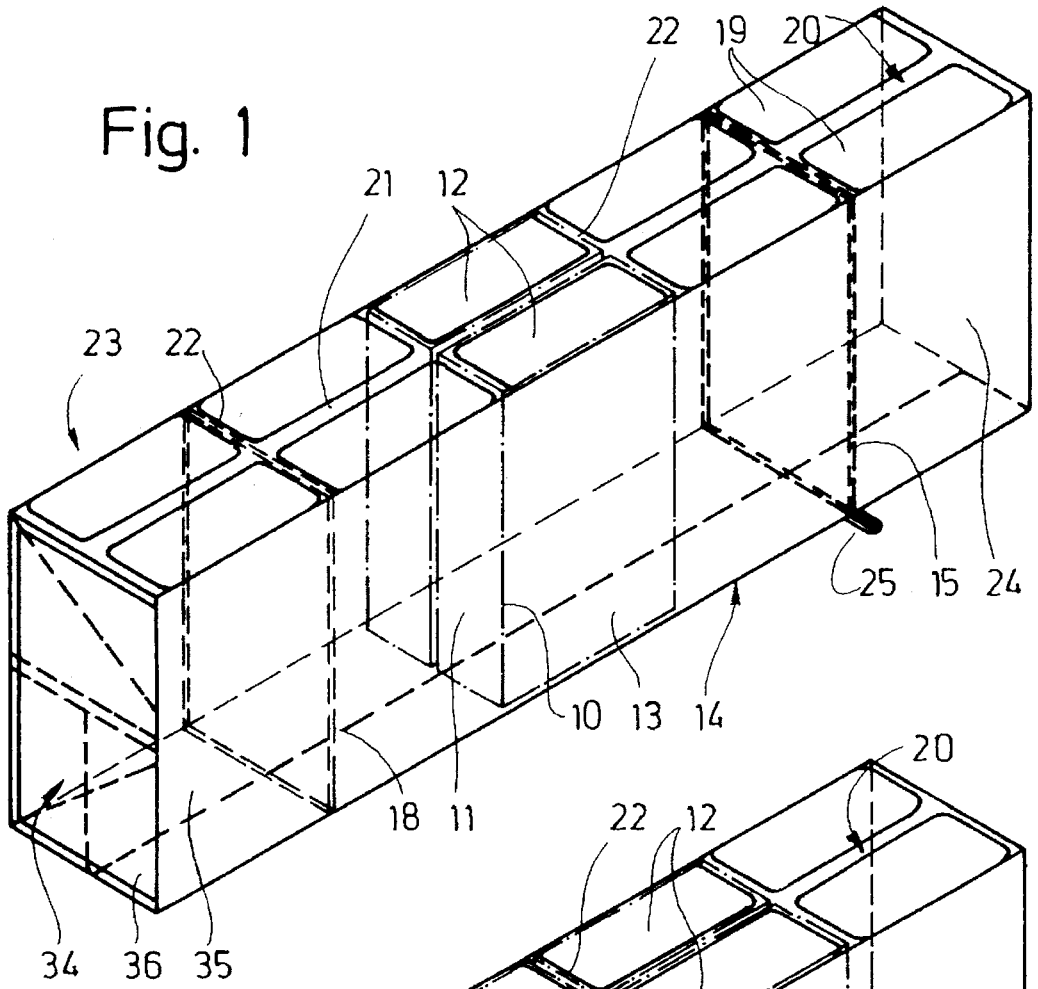
FIG. 1 shows a bundle pack for cigarette packs in a perspective representation.

The exemplary embodiments shown in the drawing relate to the design and production of bundle packs for cigarettes. Each elongate cuboid bundle pack (FIG. 1 or FIG. 2) contains ten cuboid cigarette packs 10. These are arranged in a special formation, namely in two rows, in such a way that narrow, elongate side faces 11 of adjacent cigarette packs 10 of one row bear against one another. Smaller end faces 12 or bottom faces 13 are directed sideways or upwards and downwards, respectively, but in all events lie out of contact with adjacent cigarette packs 10.

The group of cigarette packs 10 which is arranged thus is surrounded by an outer wrapping 14. In the present examples, this consists of paper, but can also consist of another material, such as plastic foil or thin cardboard. The group of cigarette packs 10 is completely surrounded by the outer wrapping 14.

The outer wrapping 14 consists of a rectangular blank (FIG. 5, FIG. 6, FIG. 8) which is severed from a continuously supplied material web of corresponding width and which is supplied to a packaging station. The blanks for the outer wrapping 14 are provided with reinforcements which bring about a local increase in the tearing strength, especially in the regions of increased load on the outer wrapping 14.

Figure 5:
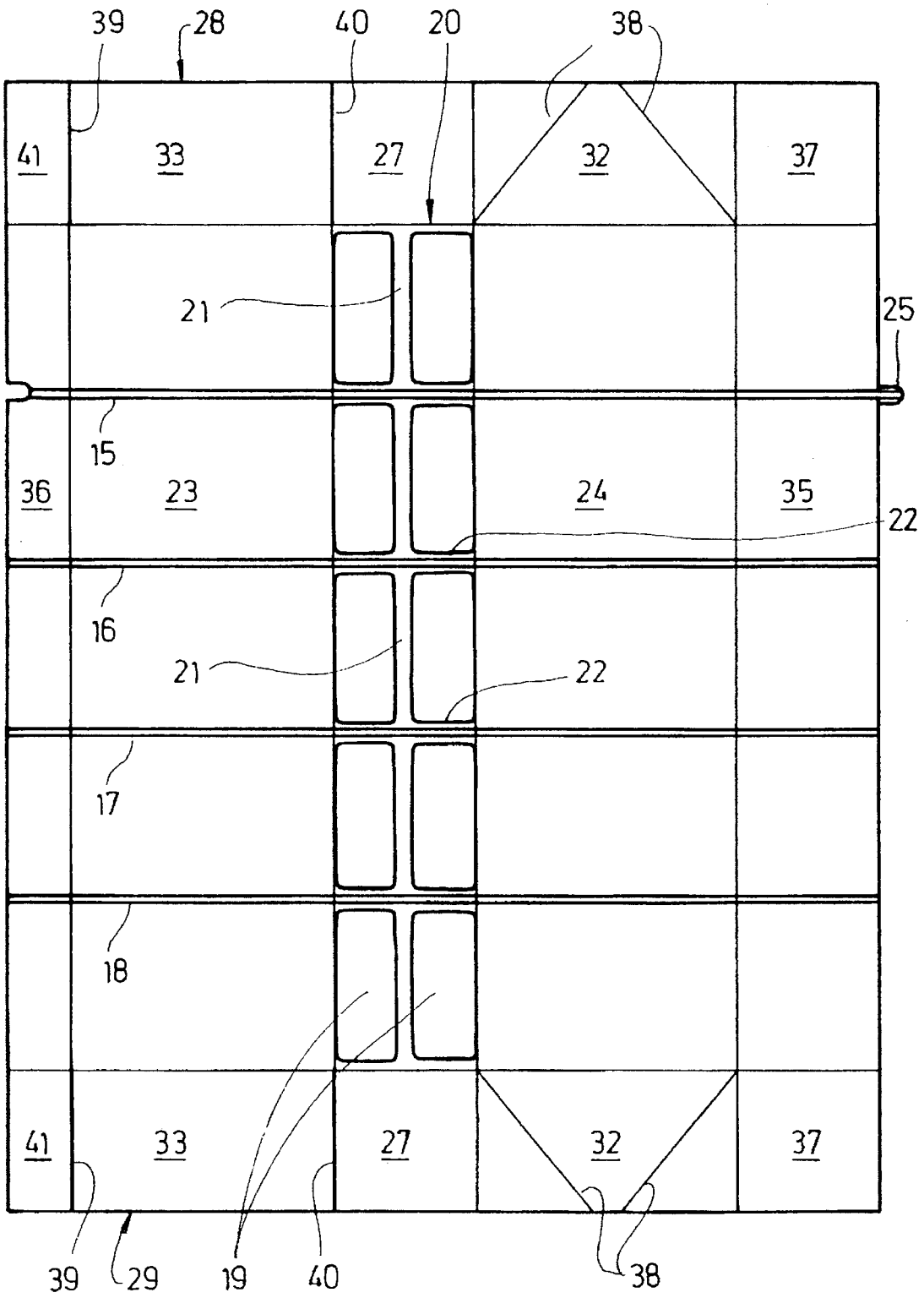
FIG. 5 shows a blank for a pack according to FIG. 1, in the spread-out state.
Figure 6:
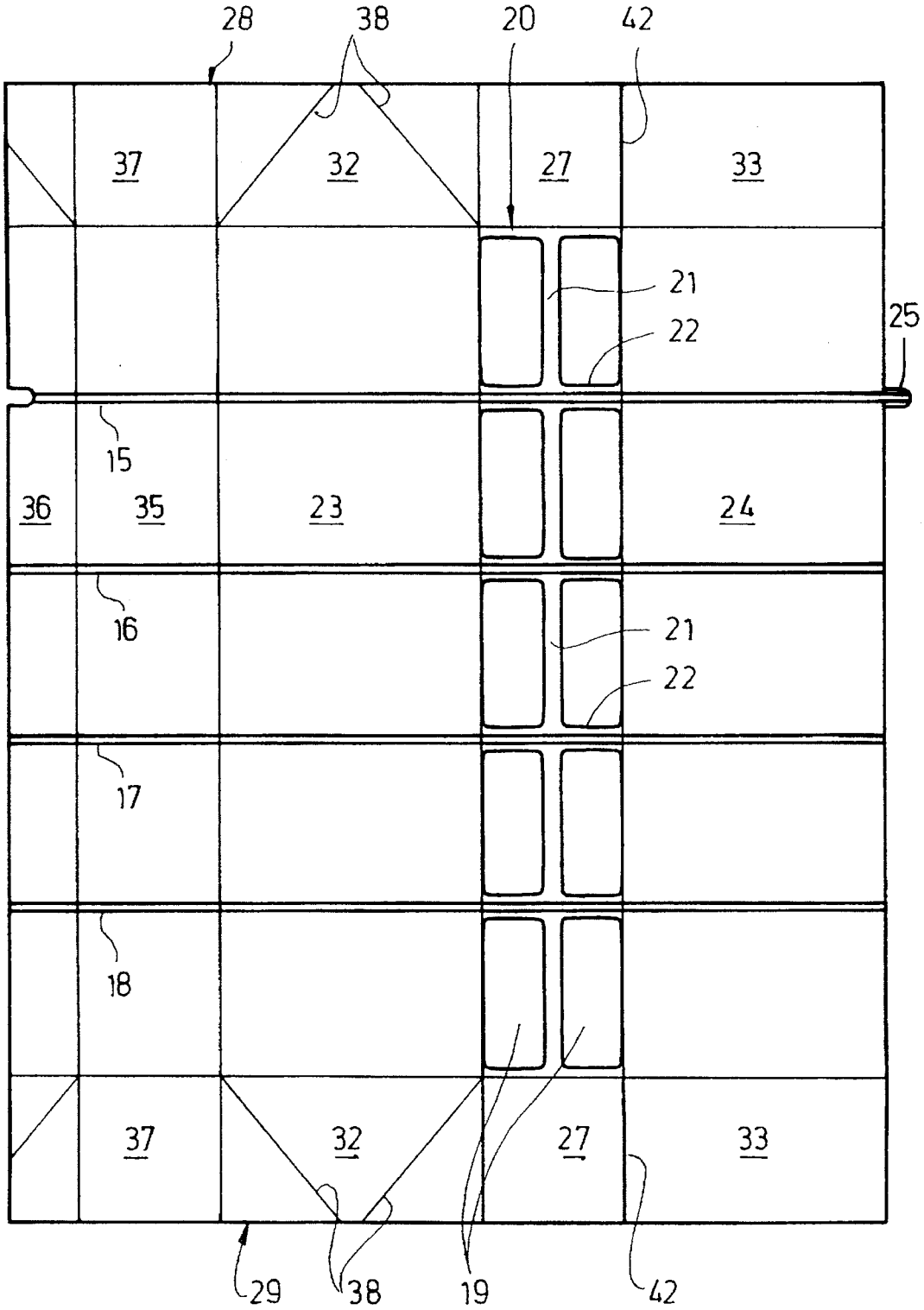
FIG. 6 shows a blank in a corresponding representation for the pack according to FIG. 2.

In the exemplary embodiments of FIG. 5 and of FIG. 6, there is provided a plurality of reinforcing strips 15, 16, 17, 18 which extend in the conveying direction of a material web (not shown) for the blanks of the outer wrappings 14 or in the direction of transport of these. The reinforcing strips 15 to 18 can consist of a suitable material, especially of plastic having increased tearing strength. The reinforcements can be connected, preferably over their entire area, to the inside of the outer wrapping 14 or of the continuous material web by adhesive bonding or by heat-sealing. The connection is such that a composite effect together with the reinforcements is provided in terms of the durability of the pack or of the outer wrapping 14.

In the exemplary embodiment mentioned, the narrow reinforcing strips 15 to 18 are arranged at equal distances from one another, namely according to the width of the cigarette packs 10. Altogether four reinforcing strips 15 to 18 running parallel are provided here. They extend respectively in the planes between adjacent groups of two of the cigarette packs 10.

In the exemplary embodiments illustrated, the outer wrapping 14 is provided with windows or recesses 19. These are positioned in such a way that the end faces 12 or the bottom faces 13 of all the cigarette packs 10 extend in the region of a recess 19. As a result, markings, especially revenue stamps, can be affixed to the exposed end faces 12 or bottom faces 13 of the cigarette packs 10, with the outer wrapping 14 closed.

The recesses 19 are arranged in the region of one side wall 20 of the outer wrapping 14, specifically over the entire length of the latter. The recesses 19 are delimited from one another by a continuous longitudinal web 21 in the longitudinal direction of the side wall 20 and by transverse webs 22. The latter extend from a large-area top wall 23 as far as an opposite bottom wall 24. The recesses 19 therefore reach as far as this top wall 23 and as far as the bottom wall 24.

Figure 2:
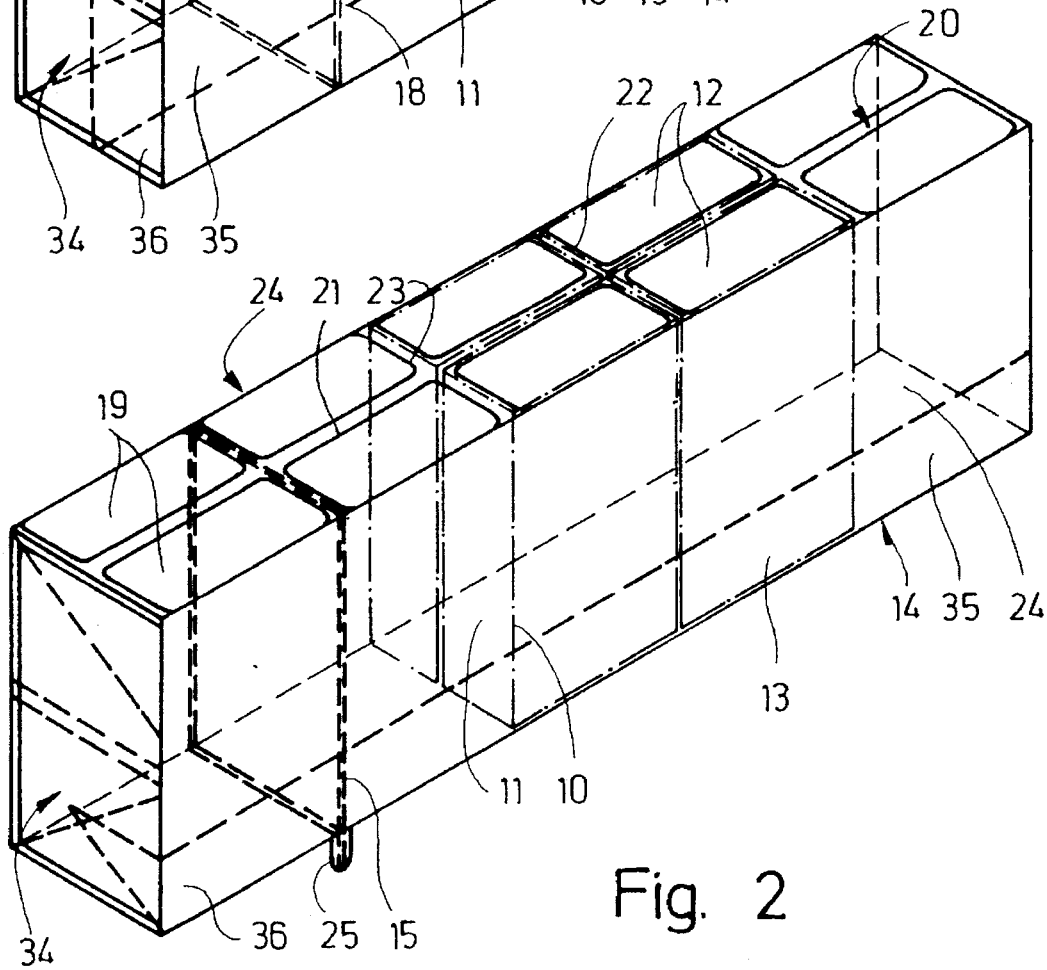
FIG. 2 shows another exemplary embodiment of a pack in a representation corresponding to that of FIG. 1.
Figure 3:
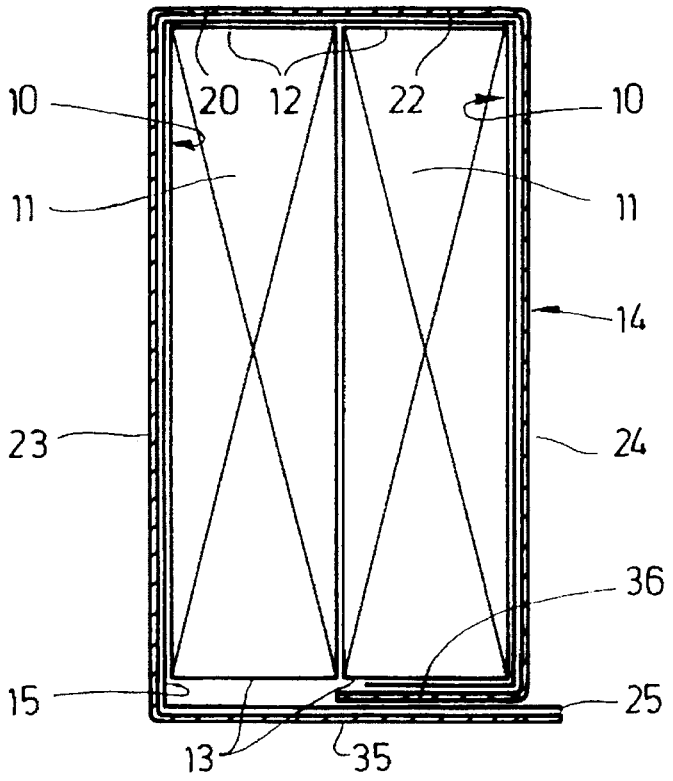
FIG. 3 shows the pack according to FIG. 1 in cross section, on an enlarged scale.
Figure 4:
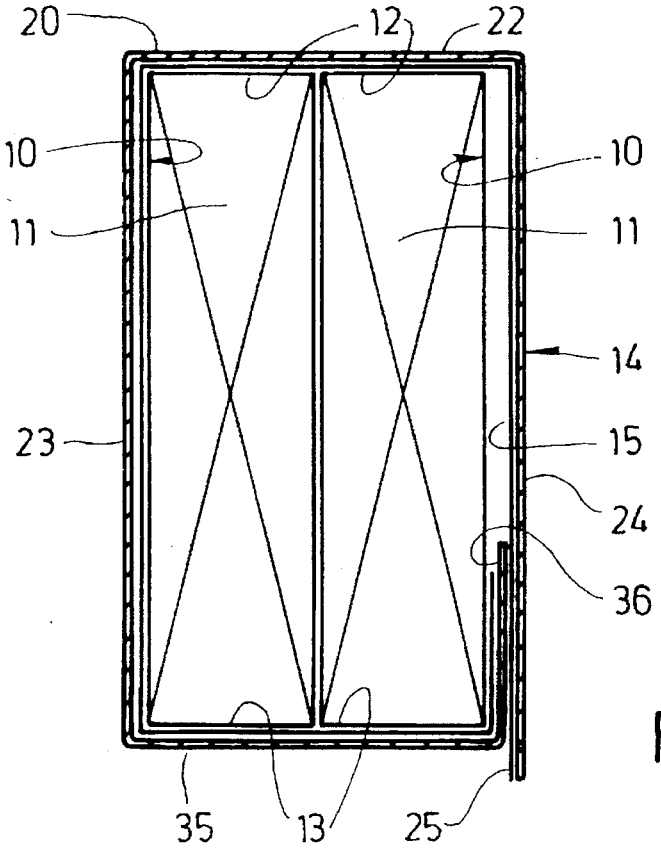
FIG. 4 shows a cross-section corresponding to that of the exemplary embodiment of FIG. 2.

The reinforcing strips 15 to 18 are arranged in such a way that they run in the region of the transverse webs 22, specifically centrally relative to these. The transverse webs 22 are thereby safeguarded especially against destruction as a result of increased tensile stresses. These can occur, above all, during the packaging operation when the blank for the outer wrapping 14 is kept ready in a plane transverse to the direction of transport of the cigarette packs 10 to be wrapped and is folded around these in a U-shaped manner. At the same time, the blank for the outer wrapping 14 is positioned so that the group of cigarette packs 10 is conveyed with their end faces 12 or bottom faces 13 towards the side wall 20. The transverse webs 22 are consequently exposed to increased tensile forces which are absorbed by the reinforcing strips 15 to 18. These extend over the entire dimension of the blank for the outer wrapping 14 in the direction of transport of the latter, so that the finished bundle pack is wrapped round by the reinforcing strips 15 to 18 (FIG. 1 or FIG. 2).

Figure 7:
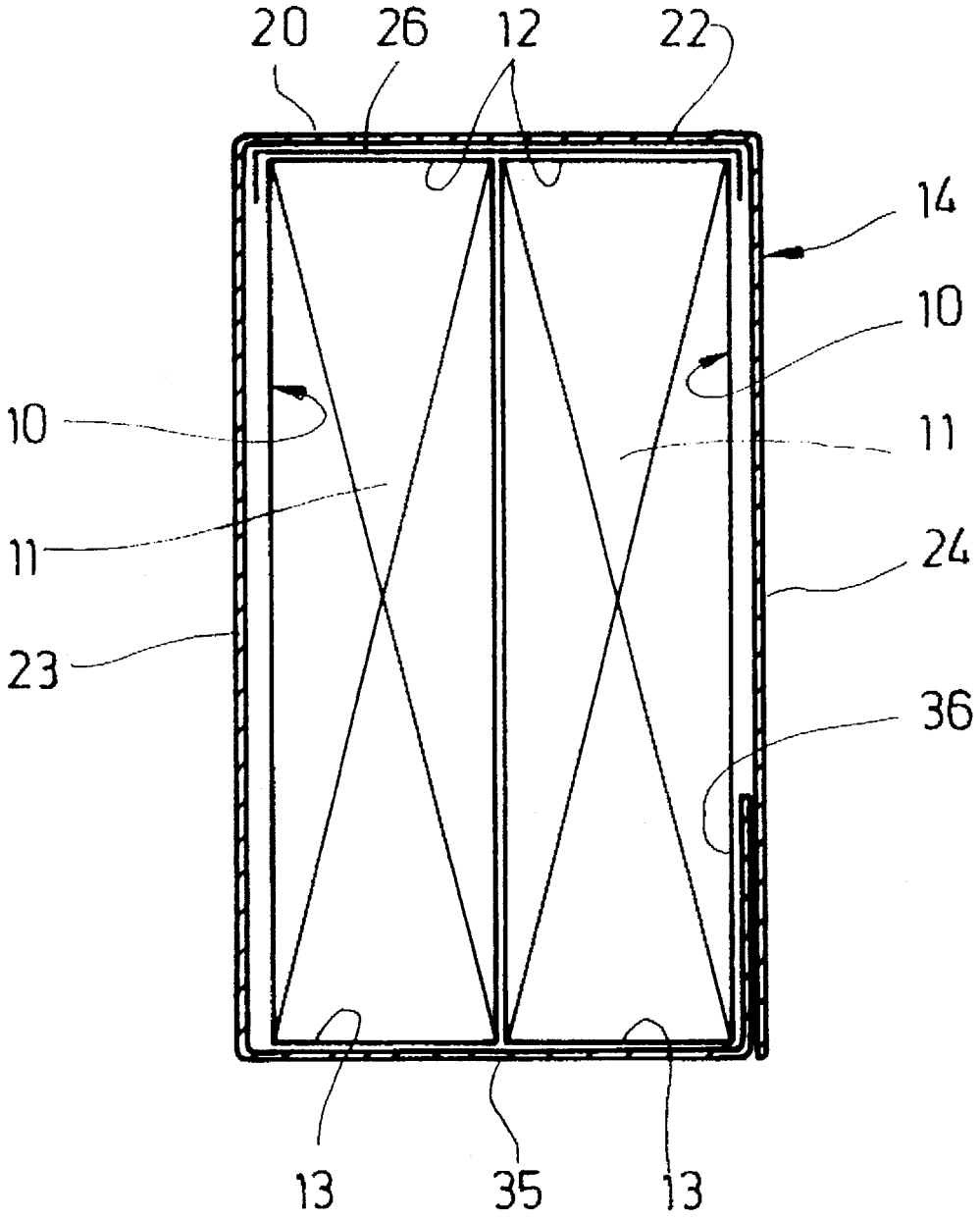
FIG. 7 shows a cross-section similar to that of FIG. 3 or FIG. 4, for a further exemplary embodiment of a pack.
Figure 8:
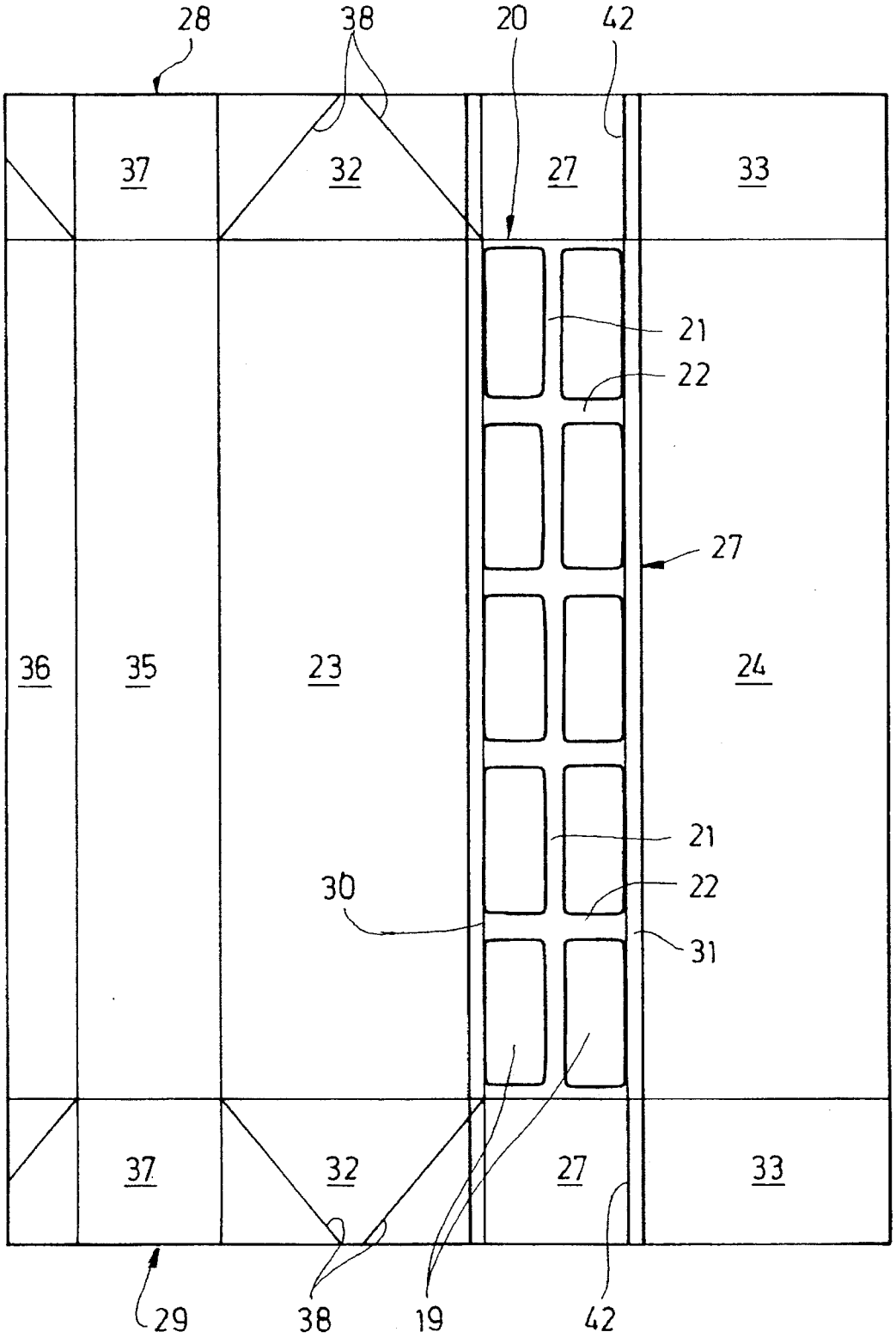
FIG. 8 shows a spread-out blank for the pack according to FIG. 7.

In the exemplary embodiments illustrated, the reinforcing strip 15 is at the same time designed as a tear-open strip, with a gripping tab 25 at one end. FIG. 7 and FIG. 8 show an alternative for a local reinforcement of the blank for the outer wrapping 14 according to the loads occurring or according to the material weakenings determined by the design of the pack. In this exemplary embodiment, a material reinforcement surrounding the recesses 19 all-round is provided. This is a strip-shaped reinforcing label 26 made from paper or plastic foil of increased tearing strength. The reinforcing label 26 is affixed preferably to the inside of the blank for the outer wrapping 14, specifically by adhesive bonding or heat-sealing.

In the present exemplary embodiment, the reinforcing label 26 is designed as a material strip which extends over the entire dimension of the blank for the outer wrapping 14 transversely relative to the conveying direction of the blank, that is to say transversely relative to the direction of a material web for the blanks. At the same time, the reinforcing label 26 covers not only the entire area of the side wall 20, but also side tabs 27 adjoining the latter at both ends. These are part of a side strip 28 or 29 of the blank for forming end walls 34 of the bundle pack.

The reinforcing label 26 extends over and beyond the side wall 20 also in terms of width. Edge strips 30, 31 of the reinforcing label 26 run in the region of the adjoining top wall 23 and bottom wall 24 or in the region of longitudinal tabs 32, 33 of the side strips 28, 29. Folding edges between the side wall 20, on the one hand, and the top wall 23 and bottom wall 24, on the other hand, are therefore covered by the reinforcing label 26, so that the bundle pack acquires increased stability.

The blanks for the outer wrapping 14, which are reinforced in the way described, are produced in a special way. In the exemplary embodiment according to FIG. 5 and FIG. 6, the blanks are divided off from a continuous material web by means of transversely directed severing cuts. The reinforcing strips 15 to 18 are previously applied continuously to the material web during the transport of the material web and are connected to the latter. The blanks thus completed can, after being severed from the material web, be supplied to a packaging station of the packaging machine in the known customary way by a continuation of transport in the same direction.

In a blank according to FIG. 8, the former is first severed from the continuous material web in the way described above. The reinforcement, namely the reinforcing label 26, is affixed during a transport of the blank directed transversely to the conveying direction of the material web. This sideways or transversely directed transport of the blank takes place in the direction of the longitudinal extension of the reinforcing label 26. During the transverse movement, the latter, as part of a continuous material strip, is applied to the blank and is severed in the correct position from the material strip. Thereafter, that is to say after the reinforcing label 26 has been affixed, in this exemplary embodiment the punching of the recesses 19 is carried out. The punching accordingly involves the reinforcing label 26 and the side wall 20 covered by the latter. The recesses 19 are thereby surrounded exactly by the correspondingly shaped reinforcing strip 26.

The blanks according to FIG. 5 on the one hand and according to FIG. 6 and FIG. 8 on the other hand differ in the constructive design and in foldings in the region of end walls 34 of the bundle packs. In the version according to FIG. 5, a material strip for forming a side wall 35 located opposite the side wall 20 adjoins the free side of the bottom wall 24. In the finished pack, this side wall 35 is itself connected (by adhesive bonding) to a connecting strip 36 which is formed on the free side of the top wall 23. The connecting strip 36 bears against the inside of the side wall 35 (FIG. 1).

The end walls 34 are designed so that the side tabs 27 adjoining the side wall 20 and the side tabs 37 adjoining the side wall 35 are located on the inside, namely directly against the pack contents. The inner longitudinal tab 32 is thereupon folded, specifically in an envelope-like fold with folding lines 38 extending diagonally or obliquely. There serves as an outer cover the longitudinal tab 33 which is severed by severing cuts 39, 40 from the adjacent side tab 27 or from a folding tab 41 formed in a continuation of the connecting strip 36. The outer longitudinal tab 33 thus serves as a covering tab which completely covers the face of the end wall 34.

In the version according to FIG. 6 or 8, a corresponding folding geometry is provided. Here, the outer longitudinal tab 33 is located at one end of the side strip 28, 29. The outer longitudinal tab 33 is severed from the adjacent side tab 27 by means of a severing cut 42. In this version too, therefore, the outer longitudinal tab 33 completely covers the end face 34. In this version of the blank, the connecting strip 36 is connected to the side wall 35.

What is claimed is:

1. A bundle pack comprising a group of individual cigarette packs (10), and an outer wrapping (14) made from thin packaging material and enwrapping said group of individual cigarette packs (10), said cigarette packs having large front and rear walls, narrow side faces (11), and small end faces (12) and bottom faces (13), wherein:

said, cigarette packs (10) are arranged in two rows of five cigarette packs each come to rest in the bundle pack, the cigarette packs (10) resting next to one another with the large front walls or rear walls and, within the same row, with the narrow side faces (11), and the cigarette packs have 2×5=10 end faces (12) or bottom faces (13) facing towards the bundle pack, b) the outer wrapping (14) has a side wall (20) containing a plurality of windows (19) functioning as means through which markings or stamps may be affixed on the end (12) or bottom (13) faces which come to rest adjacent said side wall (20) of the outer wrapping (14);

c) the plurality of windows (19) are punched out in a region of the side wall (20) and are delimited from one another by only four transverse parallel webs (22) of the packaging material, the transverse webs (22) extending transversely relative to the side wall and thus transversely over both said rows of cigarette packs; and d) tear-resistant reinforcing strips (15 to 18) are connected to the outer wrapping (14) along the transverse webs (22), so that the outer wrapping (14) consists of the packaging material and the reinforcing strips (15 to 18) in the region of the transverse webs.

2. The bundle pack according to claim 1, wherein the reinforcing strips (15 to 18) are narrower than the transverse webs (22) and respectively extend centrally along the transverse webs (22).

3. The bundle pack according to claim 1, wherein the reinforcing strips (15 to 18) extend all-around the formed bundle pack and are connected with the outer wrapping (14) all-around the formed bundle pack.

4. The bundle pack according to claim 1, wherein each reinforcing strip (15 to 18) is connected with the outer wrapping (14) over the entire surface thereof by an adhesive bond or a thermal seal.

5. The bundle pack according to claim 1, wherein the reinforcing strips (15 to 18) are connected with an inner side of the outer wrapping (14).

6. The bundle pack according to claim 1, wherein one of said reinforcing strips (15) is configured as a tear-open strip having a gripping tab (25) with an end which is not connected with the outer wrapping (14) and which comes to rest on the outside of the outer wrapping (14).

7. The bundle pack according to claim 1, wherein said packaging material is paper.

8. The bundle pack according to claim 1, wherein:

corresponding to the number of the bottom faces (13) or end faces (12) of the packs (10), there are ten of said windows;

said four transverse webs (22) are between adjacent pairs of said windows; and correspondingly, a longitudinal web (21) is provided centrally, transversely to the transverse webs (22).

9. A bundle pack comprising a group of cigarette packs, and an outer wrapping (14) made from thin packaging material enwrapping said group of individual cigarette packs (10), said cigarette packs having end faces (12) and bottom faces (13), wherein:

a) in a region of a side wall (20) of the outer wrapping and, consequently, in a region of the end faces (12) or the bottom faces (13) of the cigarette packs (10), a reinforcing label (26) is applied onto the outer wrapping (14);

b) the reinforcing label (26) and the side wall (20) are provided with corresponding windows (19) as means for applying markings or stamps onto the end faces (12) or bottom faces (13) of the cigarette packs (10); and c) the windows (19) are delimited by transverse webs (22) and a longitudinal web (21) in the outer wrapping (14) and, at the same time, are completely surrounded by sections of the reinforcing label (26).

10. The bundle pack according to claim 9, wherein the reinforcing label (26) is arranged on an inside of the outer wrapping (14).

11. The bundle pack according to claim 9, wherein the reinforcing label (26) is connected with the outer wrapping (14) over the entire surface thereof by means of adhesive bonding or sealing.

12. The bundle pack according to claim 9, wherein the reinforcing label (26), beyond a surface of the side wall (20), also covers side tabs (27) adjoining the side wall (20) for the formation of end walls (34) of the bundle pack and is connected to the side tabs (27).

13. The bundle pack according to claim 9, wherein the reinforcing label (26) projects from the side wall (20) with edge strips (30, 31), each of which partly covers a wrapping top wall (23) and a wrapping bottom wall (24) which adjoin the side wall (20), such that folding edges between said side wall and said top and bottom walls (20, 23 and 20, 24) are reinforced.

14. The bundle pack according to claim 9, wherein the packaging material is paper.

* * * * *